United States Patent [19]

Goldbach et al.

[11] Patent Number: 4,774,969

[45] Date of Patent: Oct. 4, 1988

[54] METHOD AND APPARATUS FOR ACCUMULATING PARTICLES OF TOBACCO INTO BATCHES AND FOR FORMING A COMPOSITE STREAM CONTAINING SEVERAL TYPES OF TOBACCO

[75] Inventors: Manfred Goldbach, Hamburg; Siegfrid Marquardt, Westerau; Jochim Myohl, Wentorf, all of Fed. Rep. of Germany

[73] Assignee: Körber AG, Hamburg, Fed. Rep. of Germany

[21] Appl. No.: 836,387

[22] Filed: Mar. 5, 1986

[30] Foreign Application Priority Data

Mar. 9, 1985 [DE] Fed. Rep. of Germany ..... 3508497

[51] Int. Cl.[4] ..... A24C 5/18

[52] U.S. Cl. ..... 131/84.3; 131/84.1; 131/84.4

[58] Field of Search ..... 131/84.1, 84.3, 84.4, 131/108, 110, 282, 61.1, 904, 905, 906

[56] References Cited

U.S. PATENT DOCUMENTS

| | | | |
|---|---|---|---|
| 3,795,249 | 3/1974 | Cristiani | 131/84.4 |
| 3,854,486 | 12/1974 | Molins et al. | 131/84.4 |
| 3,854,487 | 12/1974 | Molins et al. | 131/61.1 |
| 4,009,722 | 3/1977 | Wahle et al. | 131/84.4 |
| 4,373,538 | 2/1983 | Steiniger | 131/108 |
| 4,485,826 | 12/1984 | Holzangel | 131/84.4 |
| 4,516,585 | 5/1985 | Pinkham | 131/84.4 |
| 4,556,071 | 12/1985 | Hoffmann | 131/84.4 |
| 4,564,028 | 1/1986 | Heitmann | 131/84.4 |
| 4,605,013 | 8/1986 | Goldbach | 131/108 |
| 4,616,662 | 10/1986 | Hartmann et al. | 131/84.1 |

*Primary Examiner*—V. Millin

*Attorney, Agent, or Firm*—Peter K. Kontler

[57] ABSTRACT

Smokable particles of a first type are withdrawn from a source and are gathered into a narrow stream on a belt conveyor whereon the stream is trimmed prior to transport through a pneumatic conduit wherefrom the stream issues to impinge upon the peripheral surface of a rotating wheel having peripheral pockets for accumulation of batches of smokable particles. The batches are transferred onto a belt conveyor to form a file with gaps between successive batches, and such gaps are filled by smokable particles of a second type before the resulting composite stream is homogenized, equalized and draped into a web of cigarette paper to form a cigarette rod which is severed across the batches or across the accumulations of smokable particles of the second type to yield a series of plain cigarettes of unit length or multiple unit length.

51 Claims, 7 Drawing Sheets

METHOD AND APPARATUS FOR ACCUMULATING PARTICLES OF TOBACCO INTO BATCHES AND FOR FORMING A COMPOSITE STREAM CONTAINING SEVERAL TYPES OF TOBACCO

CROSS-REFERENCE TO RELATED CASES

The apparatus of the present invention is identical with the apparatus which are disclosed in the commonly owned copending patent applications Ser. Nos. 06/836,389 now U.S. Pat. No. 4,703,764 and 06/836,527 now U.S. Pat. No. 4,693,262 both filed Mar. 5, 1986.

The apparatus of the present invention constitutes an improvement over and a further development of apparatus which are disclosed in numerous pending United States and other applications and granted United States and other patents of the assignee. Reference may be had to U.S. patent applications Ser. Nos. 557,641 (filed Dec. 2, 1983 by Heitmann) and 557,733 (filed Dec. 2, 1983 by Wahle et al.) and to U.S. Pat. Nos. 4,463,768 to Quarella, 4,564,026 to Wahle et al., 4,564,027 to Heitmann, and 4,485,826 to Holznagel.

BACKGROUND OF THE INVENTION

The present invention relates to a method of and to an apparatus for forming a rod-like filler of fibrous material, and more particularly to improvements in methods of and apparatus for making a filler which contains several types of fibrous material, especially particles of tobacco leaves.

As used herein, the term "fibers" is intended to embrace particles of fibrous material which are used in the tobacco processing industry, especially particles of natural tobacco leaves, reconstituted tobacco, substitute tobacco (e.g., cellulose) and fibrous materials which are used in filters for tobacco smoke. Particles of tobacco leaves, reconstituted tobacco and/or substitute tobacco can consist of highly aromatic materials having a high or low nicotine content as well as of mild substances with a high or low nicotine content.

Commonly owned U.S. Pat. No. 4,009,722 to Wahle et al. discloses a method of and a machine for making cigarettes with composite fillers. The machine has a rotary wheel-shaped conveyor with peripheral pockets for accumulation of batches consisting of a first type of tobacco particles which are showered into the pockets, and the batches are thereupon assembled with a second type of tobacco in such a way that the resulting composite stream contains a file of batches which alternate with accumulations of tobacco particles of the second type. The composite stream is converted into a filler which is draped and is subdivided into cigarettes wherein the ends which are to be lighted contain "good' (aromatic) tobacco particles and the other ends (through which tobacco smoke is drawn) contain tobacco of lower quality or substitute tobacco.

Commonly owned copending patent application Ser. No. 575,169 filed Jan. 30, 1984 by Goldbach discloses a modified apparatus wherein a stream of tobacco particles is propelled into the pockets of a rotary conveyor by compressed air A drawback of presently known batch forming apparatus is that they cannot ensure the formation of identical or substantially identical batches of tobacco particles or like fibrous materials. Thus, certain pockets receive larger quantities and other pockets receive smaller quantities of a particular type of tobacco which affects the quality of the filler and of smokers' products which are obtained as a result of draping of the filler into a web of wrapping material and subdivision of the resulting rod into sections of unit length or multiple unit length.

OBJECTS AND SUMMARY OF THE INVENTION

An object of the invention is to provide a novel and improved method of accumulating at least substantially identical batches of fibrous material, such as fragments of tobacco leaves.

Another object of the invention is to provide a novel and improved method of treating the particles prior to accumulation into batches or like configurations.

A further object of the invention is to provide a novel and improved method of treating particles of tobacco leaves on their way toward a station where the particles are converted into batches.

An additional object of the invention is to provide a novel and improved method of making a composite stream which contains several types of fibrous material, such as high-quality and lower-quality tobacco.

Still another object of the invention is to provide a novel and improved method of making a tobacco filler wherein sections containing fibrous material of a first type alternate with sections containing fibrous material of a second type.

An additional object of the invention is to provide a novel and improved mode of homogenizing and equalizing a composite stream containing several types of fibrous materials.

A further object of the invention is to provide a method which ensures the production of cigarettes or other rod-shaped smokers' products wherein the filler of each of a short or long series of products contains predetermined quantities of several types of fibrous materials.

Another object of the invention is to provide a method which renders it possible to establish clearcut boundaries between fibrous materials of several types upon completed assembly of such materials into a continuous stream.

An additional object of the invention is to provide a novel and improved apparatus for treating particles of fibrous material on their way toward a batch forming station.

A further object of the invention is to provide the apparatus with novel and improved means for converting the treated particles into a series of batches each of which contains the same quantity of fibrous material.

Another object of the invention is to provide an apparatus wherein a continuous stream of fibrous material is converted into a series of identical or practically identical batches in a novel and improved way.

A further object of the invention is to provide a novel and improved machine for making cigarettes and like rod-shaped smokers' products wherein the filler contains several types of smokable material.

An additional object of the invention is to provide an apparatus which can be used for the making of a novel and improved rod-like filler containing several types of smokable material, and to provide the apparatus with novel and improved means for treating the filler on its way toward the draping station.

A further object of the invention is to provide the apparatus with novel and improved means for admitting fibrous material into the pockets of a rotary wheel-shaped conveyor which converts a stream of fibrous material into a succession of identical or nearly identical batches.

Still another object of the invention is to provide the apparatus with novel and improved means for equalizing the stream of fibrous material on its way toward the batch-forming station, as well as for equalizing the composite stream which contains the batches as well as fibrous material of a different type.

A further object of the invention is to provide the apparatus with novel and improved means for recovering fibrous material which is not used for the making of batches.

Another object of the invention is to provide the apparatus with novel and improved means for simultaneously homogenizing and equalizing a composite stream which contains several types of fibrous material.

An additional object of the invention is to provide the apparatus with novel and improved means for automatically regulating the formation of batches when the quantity of fibrous material in the batches deviates from a predetermined or optimum quantity.

One feature of the invention resides in the provision of a method of forming batches from fibers of the tobacco processing industry, particularly from particles of tobacco leaves. The method comprises the steps of establishing and maintaining a supply of fibers, withdrawing fibers from the supply, gathering the withdrawn fibers into a relatively narrow elongated stream and moving the stream longitudinally into, along and beyond a predetermined path wherein the stream is confined from all sides, and converting at least a portion of the stream which issues from the path into a series of substantially identical batches. The converting step can comprise admitting increments of the stream into successive pockets of series of pockets on a driven conveyor, preferably a rotary wheel-shaped conveyor.

The gathering step preferably includes converting the withdrawn fibers into a narrow shower wherein the fibers advance in a first direction, and converting the shower into the stream wherein the fibers advance in a second direction which is inclined with reference to the first direction. The shower converting step can include propelling the fibers against one side of a driven belt conveyor. Such method then preferably further comprises the step of pneumatically holding the stream on the belt conveyor (preferably by suction).

The method preferably further comprises the step of equalizing the stream. Such equalizing step can include uniformizing the height of the stream.

The method can also comprise the step of regulating the quantity of fibers per unit length of the stream as a function of the selected quantity of fibers in the batches.

The moving step preferably comprises conveying the stream in a gaseous carrier medium, and the converting step then includes transforming a portion of the stream into batches. Such method further comprises the steps of segregating the remainder or remnant of the stream from the gaseous carrier medium and returning the segregated remainder of the stream into the supply. The segregating step can include admitting the remainder of the stream and the gaseous carrier medium into a cyclone separator.

The method can further comprise the steps of advancing the batches in the form of a file with gaps between successive batches of the file, admitting second fibers into the gaps so as to form a composite stream consisting of the batches and of accumulations of second fibers between the batches, equalizing the composite stream including removing second fibers, draping the equalized composite stream into a web of wrapping material to form a continuous rod, and subdividing the rod into rod-shaped articles of predetermined length.

The batches are normally elongated, and the method preferably further comprises the step of homogenizing the composite stream in the regions of the ends of the batches. The homogenizing step can comprise shifting second fibers transversely of the composite stream.

The advancing step can include transferring successive batches of the series of batches onto one side of a belt conveyor, and the shifting step then includes moving portions of the accumulations toward the one side of the belt conveyor.

Another feature of the invention resides in the provision of a method of making a rod which contains smokable material, particularly tobacco. The method comprises the steps of establishing and maintaining a supply of first fibers, withdrawing first fibers from the supply, gathering the withdrawn first fibers into a narrow stream and moving the stream longitudinally into, through and beyond an elongated conduit, converting at least a portion of the stream which issues from the conduit into a file of spaced-apart batches, including propelling successive increments of the stream into successive pockets of a series of pockets on a first conveyor moving in a predetermined direction in such a way that each of the increments has a component of movement in the predetermined direction on its way toward a pocket, and transferring the batches from the pockets onto a second conveyor wherein the batches form the file and the neighboring batches of the file define gaps, introducing second fibers into the gaps to thus form a composite stream wherein the batches alternate with accumulations of second fibers, and homogenizing the composite stream in the regions where the accumulations abut the neighboring batches.

The introducing step preferably includes showering second fibers into the gaps between the batches of the file.

The homogenizing step can include shifting portions of the accumulations transversely of the composite stream toward the second conveyor.

Such method can further comprise the step of drawing the composite stream into a web of wrapping material to form a continuous rod, and subdividing the rod into rod-shaped sections of predetermined length, e.g., into plain cigarettes of unit length or double unit length. The subdividing step can include cutting the rod across the batches and/or cutting the rod across the accumulations of second fibers.

An additional feature of the invention resides in the provision of an apparatus for forming batches from fibers of the tobacco processing industry, particularly from particles of tobacco leaves. The apparatus comprises a source of fibers, means for withdrawing fibers from the source, means for gathering the withdrawn fibers into a narrow elongated stream and for moving the stream in a predetermined direction along a predetermined path, including a conduit which defines a predetermined portion of the path, and means for converting, downstream of the conduit, at least a portion of the stream into a series of substantially identical batches.

The converting means preferably comprises a circulating conveyor, and the gathering means preferably further comprises a belt conveyor which defines a second portion of the path upstream of the predetermined portion. The gathering means can further comprise means for showering the withdrawn fibers onto the belt conveyor substantially transversely of the direction of advancement of the stream. Such belt conveyor is preferably permeable to air, and the apparatus preferably further comprises means (such as a suction chamber) for attracting the stream to the belt conveyor by suction.

The apparatus preferably further comprises means for equalizing the stream on the belt conveyor. The equalizing means can comprise adjustable means for removing fibers from the stream. Such apparatus preferably also comprises means for adjusting the removing means, including signal generating means for monitoring the quantity of fibers in the batches and means for changing the position of the removing means with reference to the belt conveyor in response to signals from the monitoring means.

The conduit is preferably a pneumatic conveyor wherein the stream is conveyed in a gaseous carrier medium (preferably by suction). The converting means is preferably arranged to convert a portion of the stream, and such apparatus further comprises means for segregating the remainder of the stream from the gaseous carrier medium. The segregating means can comprise a cyclone separator.

The circulating conveyor of the converting means is preferably provided with a plurality of fiber-receiving pockets, and the conduit is arranged to deliver at least the major part of the stream into the path of movement of the pockets with a component of movement in the direction of circulation of the circulating conveyor. Such apparatus preferably further comprises guide means for the fibers, and the conduit has an outlet with the guide means disposed between the outlet and the path of movement of the pockets. The circulating conveyor can comprise a rotary wheel having a peripheral surface with recesses therein whereby such recesses constitute the aforementioned pockets. The guide means preferably includes a section which is arranged to guide the stream toward the path of movement of the pockets in a direction intermediate a radial and a tangential direction with referance to the peripheral surface of the wheel. The section is preferably spaced apart from the peripheral surface of the wheel, and the converting means preferably further comprises means for pneumatically drawing fibers into successive pockets ahead of the aforementioned section of the guide means, as considered in the direction of rotation of the wheel. In other words, the means for pneumatically drawing the fibers can deflect the leader of the stream counter to the direction of rotation of the wheel so as to ensure a more reliable and more complete filling of each pocket with fibers.

The apparatus further comprises means for advancing the batches from the converting means in the form of a file with gaps between successive batches of the file, and means for introducing or admitting second fibers into the gaps between the batches of the file so that the batches and the resulting accumulations of second fibers in the gaps form a composite stream which consists of alternating batches and accumulations of second fibers. Such apparatus preferably further comprises means for equalizing the composite stream. Still further, such apparatus can comprise means for draping the equalized composite stream into a web of wrapping material. The apparatus preferably further comprises means for homogenizing the composite stream in regions where the batches abut the accumulations of second fibers. The homogenizing means can comprise means for compressing or compacting the composite stream in the aforementioned regions. The compressing or compacting means can comprise a rotary cam having at least one lobe which engages the aforementioned regions of the composite stream while the stream moves longitudinally and while the cam rotates about its axis.

The homogenizing means can comprise a trimming device which serves to remove fibers from the composite stream and to leave protuberances of second fibers in the aforementioned regions. The draping means then constitutes a component of the homogenizing means and serves to drape the trimmed composite stream into a web of wrapping material in such a way that the protuberances disappear and the composite stream is converted into a rod-like filler.

Still another feature of the invention resides in the provision of an apparatus for making a rod which contains smokable material, particularly particles of tobacco leaves. The apparatus comprises a source of first fibers, means for withdrawing fibers from the source, means for gathering the withdrawn fibers into a narrow stream and for moving the stream in a predetermined direction along a predetermined path, including a conduit which defines a predetermined portion of the path and a belt conveyor defining a second portion of the path upstream of the predetermined portion, means for converting at least a portion of the stream into a series of batches downstream of the conduit, including a rotary conveyor having a peripheral surface with a succession of pockets for the fibers of the stream (the conduit has an outlet which is adjacent to the peripheral surface of the rotary conveyor and serves to direct at least the major part of the stream toward successive pockets with a component of movement in the direction of rotation of the rotary conveyor), means for advancing the batches from the rotary conveyor in the form of a file with gaps between successive batches of the file, means for admitting second fibers into the gaps between the batches of the file so as to form a composite stream wherein batches consisting of first fibers alternate with accumulations of second fibers, means for equalizing the composite stream, and means for draping the equalized composite stream into a web of wrapping material to form a continuous rod, e.g., a continuous cigarette rod wherein several types of tobacco form a rod-like filler which is surrounded by a tube consisting of wrapping material.

Such apparatus preferably further comprises means for homogenizing the composite stream in regions where the batches abut the adjacent accumulations of second fibers. Still further, such apparatus comprises means for subdividing the rod into rod-shaped articles of predetermined length (e.g., into plain cigarettes of unit length or double unit length). The subdividing means can comprise means for cutting the rod across the batches and/or means for cutting the rod across the accumulations of second fibers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*a* is an enlarged partly sectional view of a detail in the structure of FIG. 2;

DESCRIPTION OF THE PREFERRED EMBODIMENTS

Figure 1:
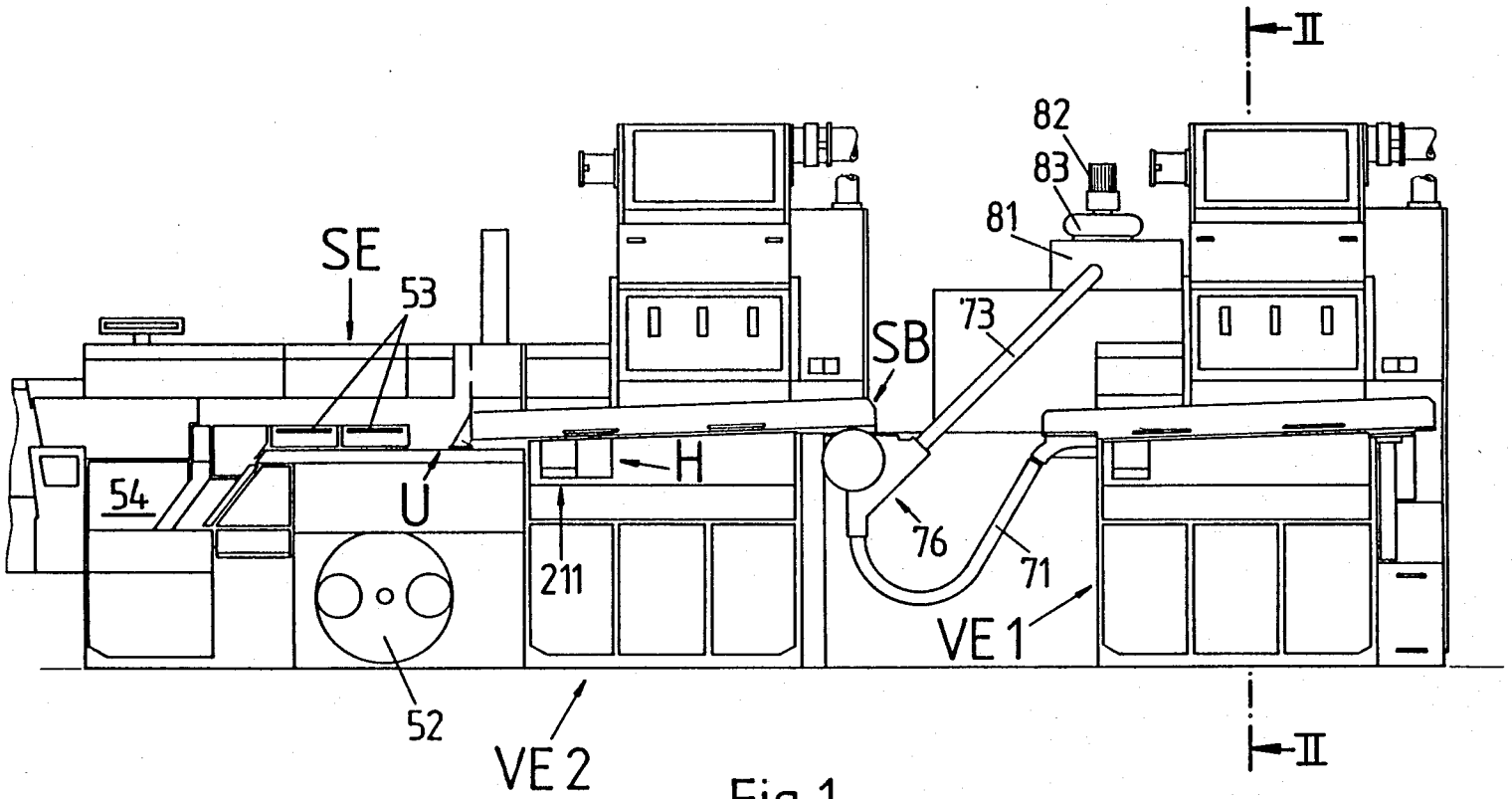
FIG. 1 is a schematic elevational view of a cigarette making machine which embodies or constitutes the improved apparatus and is designed to turn out plain cigarettes each of which contains two types of smokable fibrous material.
Figure 2:
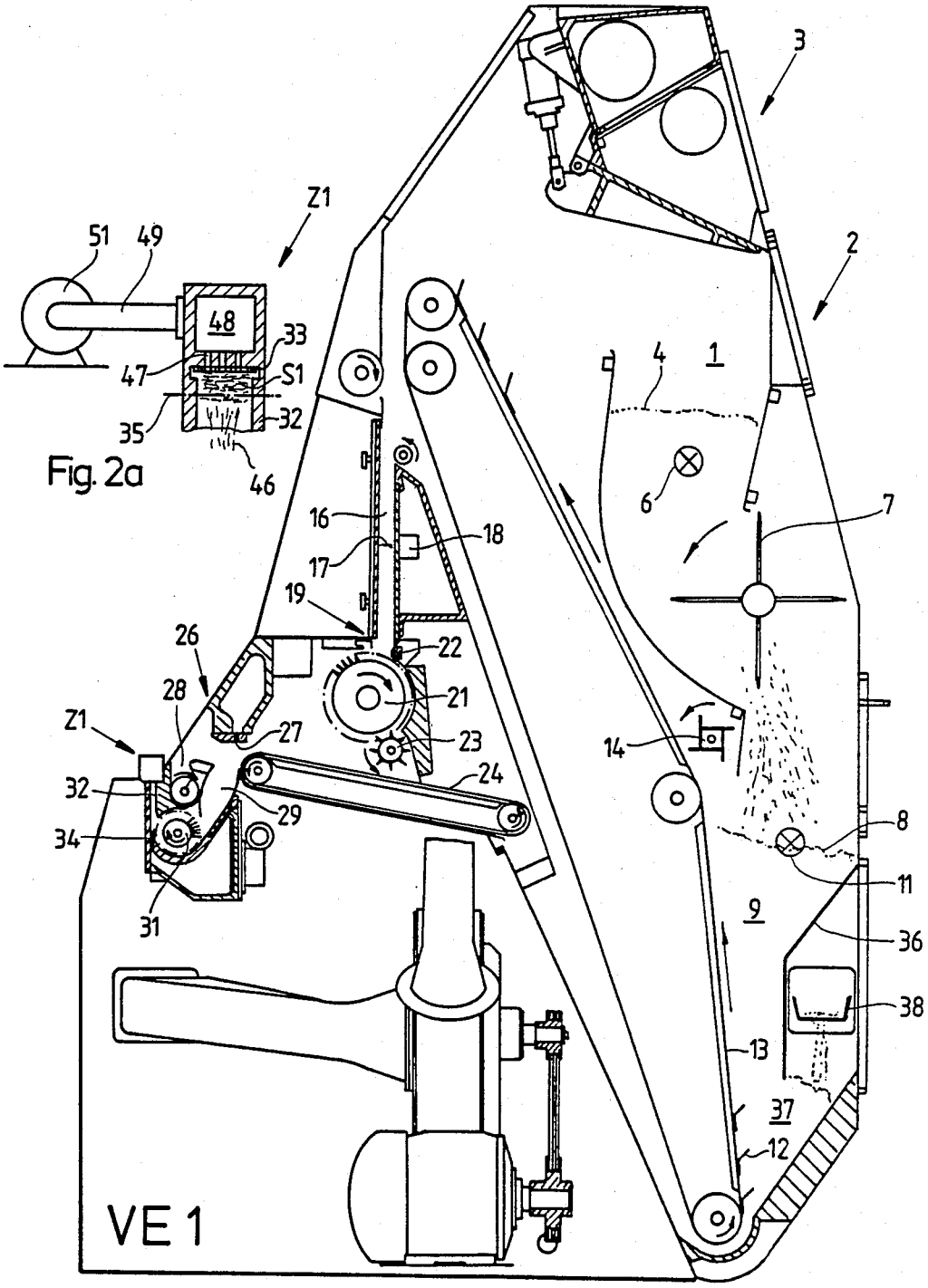
FIG. 2 is an enlarged transverse vertical sectional view as seen in the direction of arrows from the line II—II of FIG. 1.
Figure 3A:
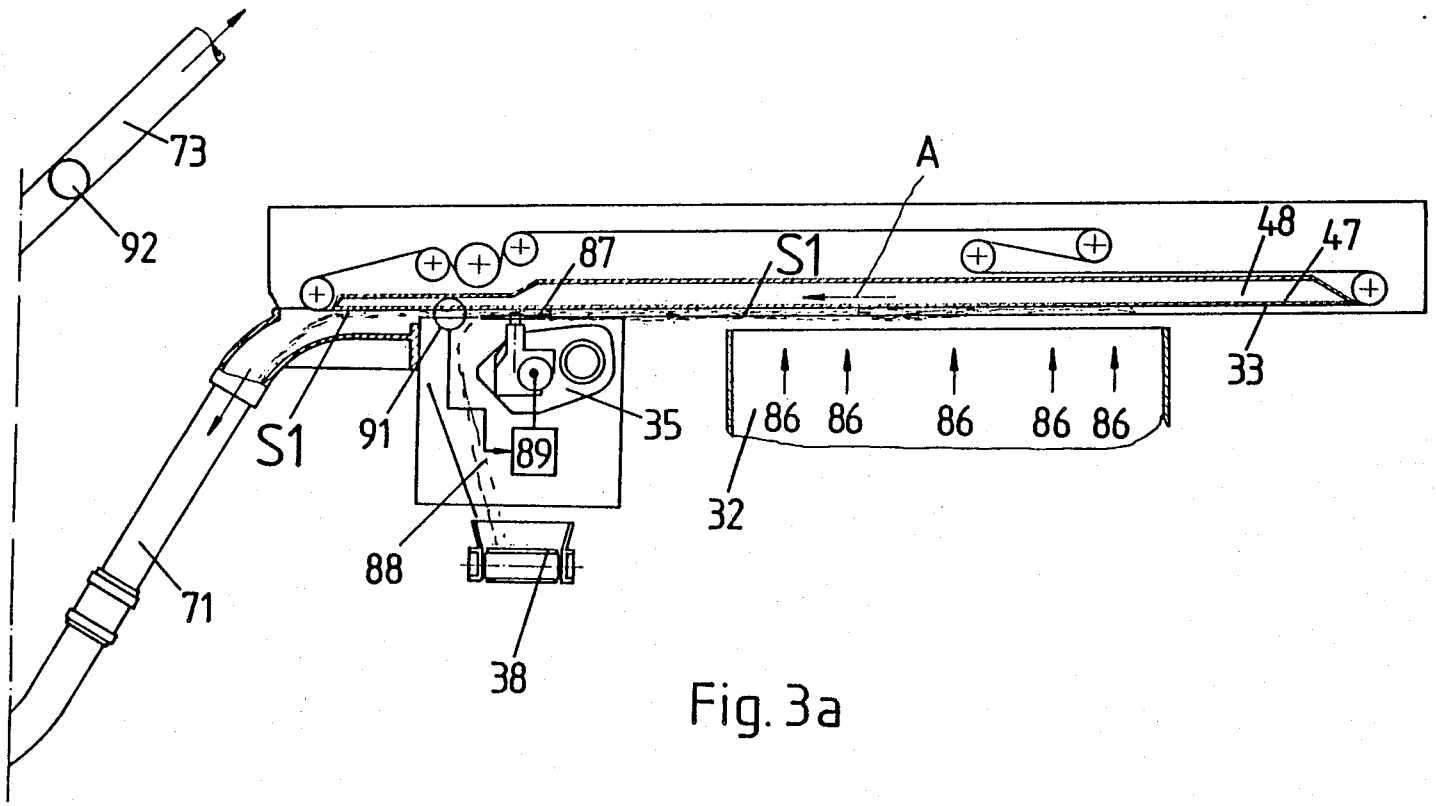
FIG. 3*a* is an enlarged partly elevational and partly longitudinal vertical sectional view of means for gathering first fibrous material into a narrow stream which is advanced to the batch forming station.
Figure 3B:
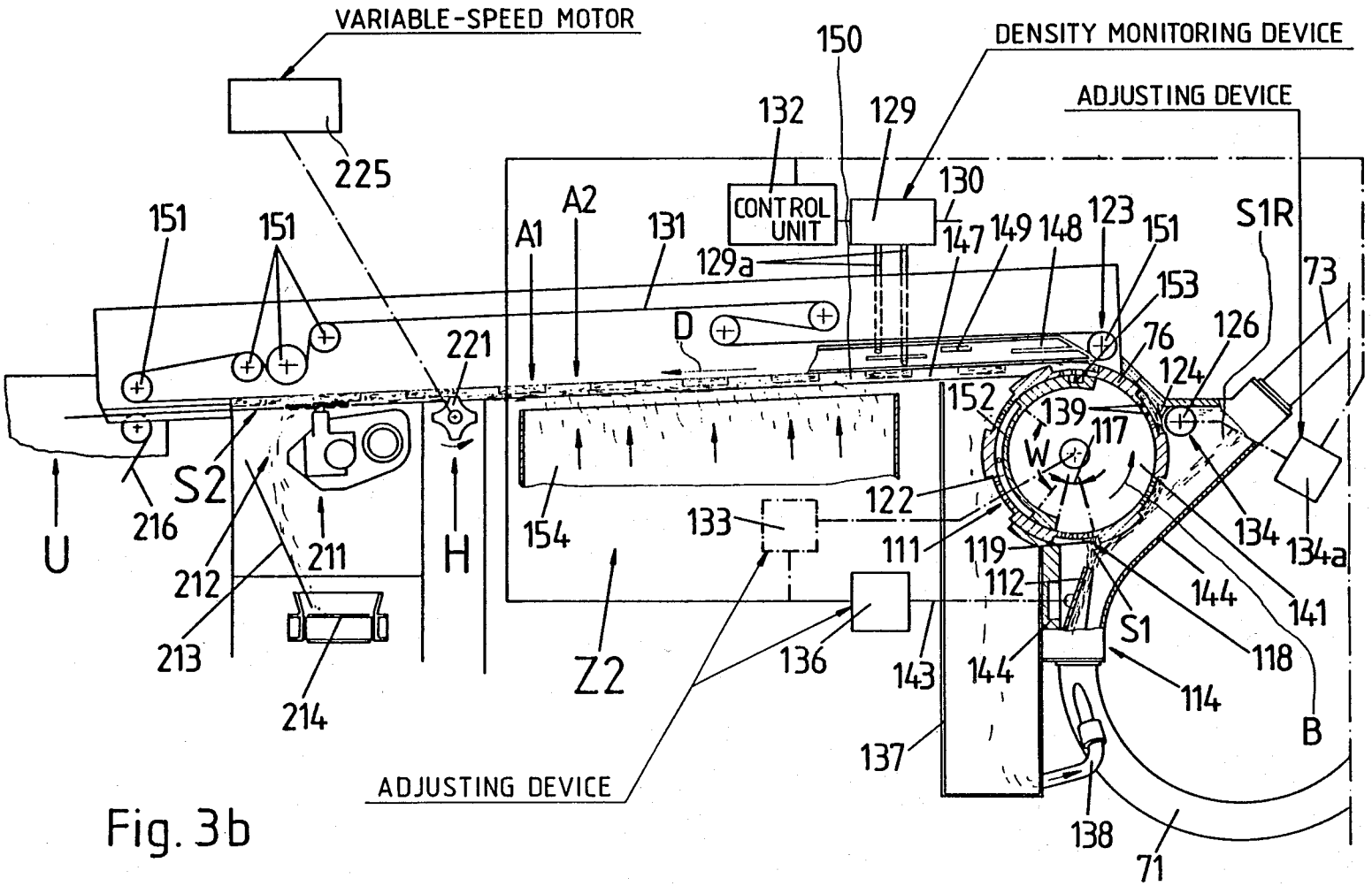
FIG. 3*b* is an enlarged vertical sectional view of the rotary stream converting conveyor at the batch forming station and a partly elevational and a partly longitudinal vertical sectional view of means for assembling batches of first fibrous material and accumulations of second fibrous material into a composite stream.
Figure 6:
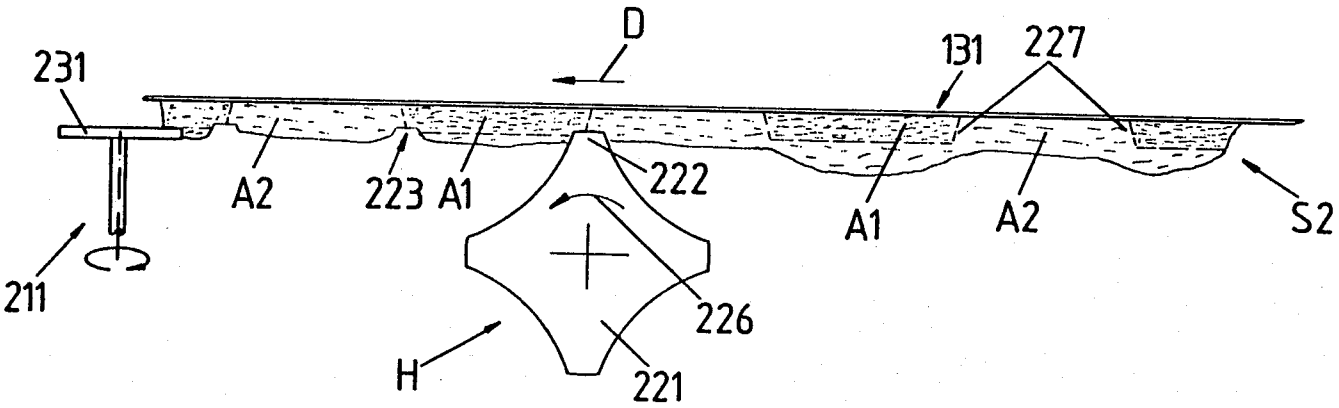
FIG. 6 illustrates a portion of the structure which is shown in FIG. 3*b* with a first embodiment of homogenizing means for the composite stream.
Figure 7:
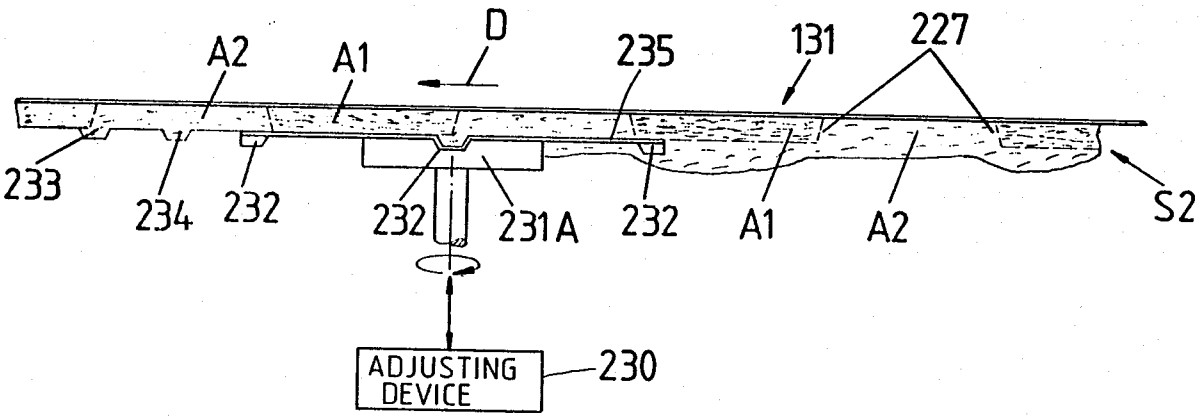
FIG. 7 illustrates the structure of FIG. 6 but with modified homogenizing means.

FIG. 1 shows schematically a cigarette rod making machine which converts a narrow filler stream S1 (FIGS. 2, 3*a*, 3*b*) consisting of a first type of tobacco particles (e.g., shreds or otherwise comminuted portions of tobacco leaves) into a series of batches A1 (FIGS. 3*b*, 6, 7) which, in turn, are combined with accumulations A2 (FIGS. 3*b*, 6, 7) consisting of a different second type of tobacco particles to form a composite stream S2 (FIGS. 3*b*, 6, 7). The composite stream S2 is thereupon homogenized and equalized prior to conversion into a continuous rod-like filler which is simultaneously draped into a web (216 in FIG. 3*b*) of cigarette paper or other suitable wrapping material, and the resulting continuous cigarette rod is ultimately subdivided in a conventional cutoff 54 (FIG. 1) to yield a succession of discrete rod-shaped articles or sections in the form of plain cigarettes of unit length or multiple unit length. The purpose of the machine which is shown in FIG. 1 and of the improved apparatus which is embodied in such machine is to produce rod-shaped smokers' articles each of which contains a tubular wrapper of cigarette paper or the like surrounding a rod-like filler of fibrous material, namely a filler having at least one first portion consisting of a first fibrous material and at least one second portion consisting of a different second fibrous material. The details of those portions or units of the apparatus which cannot be readily seen in FIG. 1 and/or which are shown in FIG. 1 on a relatively small scale are illustrated in FIGS. 2, 2*a*, 3*a*, 3*b*, 4, 4*a*, 4*b*, 4*c*, 5, 6 and 7.

The reference character VE1 designates in FIG. 1 that part of the improved apparatus (the terms apparatus and machine will be used interchangeably) which serves to form the narrow first stream S1, to recover that portion (remnant) of the first stream (shown at S1R in FIG. 3*b*) which is not accepted for conversion into batches A1, and to deliver successive increments of the first stream S1 to a wheel-shaped rotary conveyor 76 which constitutes a continuously circulating means for converting at least the major portion of the stream S1 into a succession of discrete batches A1 having at least substantially identical sizes and shapes. The part VE1 includes a pneumatic conduit or conveyor 71 which defines a predetermined portion of the path for travel of the stream S1 toward a batch forming station 118 (FIG. 3*b*) where the stream is converted into a series of batches A1. The conduit 71 confines the stream S1 from all sides on the way from the underside of the lower reach of an air-permeable endless belt conveyor 33 (FIGS. 2*a*, 3*a*) which defines a second portion of the path for the stream S1 and receives a narrow shower 46 (FIG. 2*a*) of tobacco particles of the first type from a duct 32 (FIGS. 2, 2*a* and 3*a*) forming part of a means for transferring particles of the first type from a relatively small supply 8 in a magazine 9 or an analogous source (FIG. 2) to the underside of the lower reach of the conveyor 33. A second pneumatic conduit 73 of the part VE1 serves to transport (preferably by suction) the non-accepted portion or remnant S1R of the stream S1 back toward the magazine 9 and preferably into the lower portion 37 of the magazine at a level below the supply 8 of first fibrous material. The means for drawing the gaseous carrier medium (preferably air) through the conduits 71 and 73 (i.e., into the inlet of the conduit 71 adjacent to the discharge end of the belt conveyor 33, toward and through the outlet 114 (FIGS. 3*b*, 4, 4*a*) of the conduit 71 and thereupon into the intake end and toward and beyond the discharge end of the conduit 73) comprises a fan or another suitable suction generator 83 forming part of a cyclone separator 81 mounted on the housing of the part VE1 and serving to segregate the gaseous carrier medium from the particles of the stream portion or remnant S1R. The exact construction of the cyclone separator 81 forms no part of the present invention; FIG. 1 merely shows the aforementioned fan 83 and a motor 82 which drives the fan so as to draw the gaseous carrier medium into the intake end and toward and out of the discharge end of the conduit 73. The segregated fibrous material is returned into the magazine 9 in a manner which is not specifically shown in the drawing. If the stream S1 is advanced by a compressed gaseous carrier medium, the cyclone separator can be replaced with a simple air lock having a set of rotary vanes of the type often used in tobacco processing machines. The casing of the cyclone separator 81 preferably confines a suitable curved guide surface which effects a reliable segregation of fibrous material from the gaseous carrier medium. The gate which discharges segregated fibrous material from the casing of the cyclone separator 81 is not shown in FIG. 1.

The conveyor 76 delivers a succession of batches A1 to a stream forming unit SB whose construction is shown in FIG. 3*b* and which serves to assemble accumulations A2 in the gaps 147 between successive batches A1 in an elongated path which is defined by the underside of the lower reach of an endless foraminous belt conveyor 131 serving as a means for advancing the thus obtained composite stream S2 in the direction of arrow D.

The accumulations A2 are formed from fibrous material of a second type which is admitted or introduced into the stream forming unit SB by a duct 154 forming one element of a part VE2 which is or can be analogous to the part VE1 and ensures that the duct 154 receives a uniform stream of fibrous material from a second magazine or other suitable source (not specifically shown). This ensures a predictable formation of accumulations A2 and hence the formation of a satisfactory composite stream S2 which can be converted into a high-quality rod-like filler for wrapping into the web 216 in a draping device U ahead of the cutoff 54. An adjustable trimming or equalizing device 211 (FIGS. 1, 3*b* and 6) is provided to equalize the composite stream S2 upstream of the draping device U. The arrangement is preferably such that the equalizing device 211 preferably removes only second fibrous material (which is delivered via duct 154 and is used to form the accumulations A2); this is desirable and advantageous because the material which is removed by the equalizing device 211 contains a single type of fibers and can be returned directly into the magazine of the part VE2.

The apparatus of FIG. 1 further comprises a homogenizing device H which is shown in greater detail in FIGS. 3*b* and 6 and whose function is to uniformize the composite stream S2 in regions (see the regions 227 in FIG. 6) where the ends of the batches A1 abut the neighboring accumulations A2. The homogenizing device H of FIGS. 1, 3*b* and 6 is designed to influence the density of the stream S2 in the regions 227 as well as to shift or displace certain portions of the accumulations A2 in a direction toward the underside of the lower reach of the belt conveyor 131 i.e., toward the means for advancing the stream S2 from a transfer station 123 where the conveyor 131 receives a file of spaced-apart batches A1 from the conveyor 76 toward and past the equalizing device 211 and into the draping device U.

The draping device U and the cutoff 54 can be said to constitute a cigarette rod forming and subdividing unit SE which follows the stream forming unit SB and can be disposed at the cigarette receiving end of a filter tipping machine, wherein plain cigarettes are converted into filter cigarettes, or at the receiving end of a packing machine for plain cigarettes. The draping device U can be of conventional design, e.g., it can comprise or constitute a so-called format wherein the filler is draped into the web 216 with simultaneous densification and conversion into a rod-shaped body having a circular or substantially circular cross-sectional outline. The web 216 is drawn off a reel 52 which is mounted on the frame of the apparatus at a level below the draping device U and must be replaced at required intervals to ensure continuous delivery of a web of cigarette paper or the like into the format of the device U. The manner in which one marginal portion of the web 216 is coated with adhesive in a paster to form with the other marginal portion an elongated seam extending longitudinally of the cigarette rod is well known. FIG. 1 further shows a tandem sealer 53 which heats the seam in order to effect rapid setting of the adhesive and to thus reduce the danger of opening the freshly formed seam during travel through the cutoff 54. The latter has one or more knives which cut the cigarette rod across the batches A1 and/or across the accumulations A2, depending on the length of the rod-shaped sections which issue from the cutoff 54.

The part VE2, the rod forming and subdividing unit SE and the equalizing device 211 are or can be identical with the corresponding units of a cigarette making machine known as PROTOS which is manufactured and sold by the assignee of the present application.

Fibrous material which is stored in the magazine 9 to form the supply 8 is a smokable material which can consist of particles of natural tobacco leaves, comminuted sheets of reconstituted tobacco and/or fragments of substitute tobacco (e.g., cellulose). The same applies for the fibrous material in the magazine of the part VE2. For example, the particles of first fibrous material can consist of aromatic tobacco with a high or low nicotine content; alternatively, such particles can consist of mild-taste tobacco having a high or low nicotine content. The term "fibers" or "fibrous material" is further intended to embrance materials which can be used as a means for filtering tobacco smoke in the mouthpieces or filter plugs of cigarettes, cigars, cigarillos and like rod-shaped smokers' articles The above observations also apply for the fibrous material in the magazine of the part VE2. As a rule, or in many instances, the two fibrous materials will be selected in such a way that the particles at the lighted end of a cigarette consist of high-quality or higher-quality tobacoo whereas the particles at the mouthpiece end consist of or contain particles of lower-quality tobacco.

The details of the part VE1 are shown in FIGS. 2 and 2*a*. FIG. 2*a* shows, drawn to a larger scale, the detail Z1 in the left-hand portion of FIG. 2. The part VE1 is or can be identical with the so-called distributor or hopper (known as VE 80) of the afore-mentioned PROTOS machine.

Referring now to FIGS. 2 and 2*a*, the part VE1 comprises a so-called preliminary or primary distributor 2 having a magazine 1 which receives fibrous material of the first type by way of an intermittently operated gate 3 at the discharge end of a pneumatic conveyor which can receive fibrous material from one or more tobacco shredding machines, not shown. The supply 4 of fibers in the magazine 1 is monitored by a photocell 6 which transmits signals to the motor for the gate 3 when the supply 4 has been depleted to a predetermined extent.

The discharge end of the magazine 1 is adjacent to a rotary star wheel-shaped gate 7 which admits portions of fibers into the magazine 9 to build up the supply 8 whose upper level is monitored by a photocell 11 serving to intermittently operate the gate 7 so as to ensure that the quantity of fibers forming the supply 8 remains at least substantially constant.

The means for withdrawing fibers from the supply 8 in the magazine 9 comprises a series of mobile parts including an endless belt-like elevator conveyor 13 with equidistant entraining elements 12 defining relatively small pockets for advancement of portions of fibrous material along an elongated path terminating at the underside of the aforementioned air-permeable belt conveyor 33 whereon the narrow stream S1 is formed under the action of a suction chamber 48 serving as a means for pneumatically attracting the growing stream and the fully grown stream S1 to the underside of the lower reach of the conveyor 33. The reference character Z1 can be said to denote a stream forming zone wherein the fibers which are withdrawn from the magazine 9 by the entraining elements 12 of the elevator conveyor 13 are converted into successive increments of the narrow stream S1.

The portions of fibrous material which are entrained by the elements 12 of the elevator conveyor 13 are equalized by a rotating paddle wheel 14 whose paddles (e.g., straps made of leather or other flexible material) brush off the surplus and cause the conveyor 13 to dump a succession of substantially identical (equalized) portions of fibers into an upright duct 16 wherein the fibers accumulate into a column 17. The height of the column 17 is monitored by a set of photocells 18 whose signals are used to control the speed of the motor which drives the elevator conveyor 13 in such a way that the height of the column 17 fluctuates within a narrow range.

The lower end portion 19 of the duct 16 is adjacent to a driven carded drum 21 which cooperates with an oscillating smoothing device 22 having a profiled agitating portion. The device 22 ensures that the column 17 descends toward the drum 21 at the rate at which fibers are being removed from the duct 16 as well as that the carding of the drum 21 is uniformly filled with fibrous material. The layer of fibers which is transported by the carding of the drum 21 is expelled by a rapidly rotating picker roller 23 which propels the expelled fibers onto the upper reach of a relatively wide apron conveyor 24. The conveyor 24 is driven at a constant speed and advances the leader of the wide carpet of fibers which accumulates on its upper reach into the range of a classifying device 26 having a row of orifices 27 for jets of compressed air or another gaseous fluid. The jets form a curtain which is traversed by the heavier particles (e.g., by fragments of tobacco ribs) but diverts the lighter particles (such as shreds of tobacco leaf laminae) into a funnel 29. The heavier particles whose trajectories remain substantially unchanged are propelled into an intercepting receptacle 28 containing a feed screw or other suitable means for continuous or intermittent evacuation of heavier particles.

The funnel 29 directs the lighter particles into the range of a rapidly rotating carded drum 31 which propels the particles into the aforementioned duct 32 wherein the particles form the narrow shower 46 whose constituents advance in directions indicated by the arrows 86 (FIG. 3*a*), i.e., at right angles to the direction (arrow A in FIG. 3*a*) of travel of the growing and fully grown stream S1 at the underside of the lower reach of the belt conveyor 33. The showering action of the carded drum 31 is assisted by jets of compressed air which issue from orifices 34 at a level below the duct 32 and impart to the fibrous material a component of movement in the direction indicated by arrows 86.

The upper side of the lower reach of the belt conveyor 33 is adjacent to the perforated bottom wall 47 of the suction chamber 48. The latter is connected to the intake of a fan 51 by a conduit 49 so as to establish a pressure differential between the two sides of the lower reach of the conveyor 33 and to thus ensure that the fibers which rise in the duct 32 adhere to and travel with the lower reach in the direction of arrow A.

The fully grown narrow stream S1 is trimmed by an adjustable equalizing device 35 (see particularly FIG. 3*a*) which uniformizes the height of the stream so that the inlet of the conduit 71 receives fixed quantities of fibers per unit of time. The surplus 88 which is removed by the cutter or cutters of the equalizing device 35 is caused to descend onto an endless belt conveyor 38 which returns the surplus into the lower portion 37 of the magazine 9 (see the lower right-hand portion of FIG. 2). A metallic or plastic partition 36 is provided in the magazine 9 to separate the bulk of the supply 8 from the contents of the lower portion 37 and to prevent penetration of fibers which form the supply 8 directly into the discharge end of the belt conveyor 38. The belt conveyor 38 can be replaced with a vibratory conveyor or with a pneumatic conveyor without departing from the spirit of the invention.

The aforementioned gate at the discharge end of the casing of the cyclone separator 81 also discharges onto the conveyor 38, i.e., the fibers of the remnant S1R of the stream S1 are returned into the magazine 9 via conveyor 38.

The structure which is shown in FIGS. 2 and 2*a* is similar to that described and shown in commonly owned copending patent application Ser. No. 622,680 filed June 20, 1984 by Werner Hartmann et al.

The equalizing device 35 is of conventional design; it can comprise two driven coplanar trimming discs 87 and a rotary brush or a shred cutting tool (not shown) at a level below the discs 87. Reference may be had to commonly owned U.S Pat. No. 4,564,028 granted Jan. 14, 1986 to Heitmann.

The trimmed stream S1 advances beyond the equalizing device 35 and leaves the lower reach of the conveyor 33 at the downstream end of the suction chamber 48 to enter the inlet of the pneumatic conduit 71 for transport toward the batch forming station 118 of FIG. 3*b*.

The means for automatically adjusting the position of the equalizing device 35 with reference to the conveyor 33 (and for thus selecting the height of the stream S1) includes a motor 89 which receives signals from a monitoring device 91 serving to scan the stream S1 downstream of the equalizing station and to generate signals which are indicative of the monitored density and/or height of the stream. The monitoring device 91 is known; e.g., it can constitute a so-called NSR detector which is manufactured and sold by the assignee of the present application and operates with a source of corpuscular radiation (e.g., beta rays). The detector ascertains the mass of fibrous material per unit length of the trimmed stream S1 and influences the level of the equalizing device 35 accordingly. The signal which is generated by the monitoring device 91 is preferably compared with a reference signal, and the equalizing device 35 is adjusted (raised or lowered) when the difference between the reference signal and the signal from the monitoring device 91 exceeds a preselected value.

In addition to or in lieu of receiving signals from the monitoring device 91, the motor 89 for the equalizing device 35 can receive signals from a second monitoring device 129 (FIG. 3*b*) which is adjacent to the path of movement of a file of spaced-apart batches A1 at the underside of the lower reach of the belt conveyor 131 and serves to ascertain the density and/or another important parameter of each of the series of batches and to transmit appropriate signals to the motor 89 when the monitored parameter of a batch A1 (or of a series of two or more successive batches A1) deviates from a predetermined optimum value. The construction of the monitoring device 129 may but need not be identical with that of the monitoring device 91. The connection (conductor) between the monitoring device 129 and the motor 89 is shown at 130.

The motor 89 can further receive signals from a third monitoring device 92 which is installed in or adjacent to the conduit 72 and ascertains the quantity of fibrous material forming the remnant or remainder S1R of the stream S1, i.e., the quantity of that fibrous material which is not accepted by the conveyor 76 at the batch forming station 118 and must be returned to the magazine portion 37 via cyclone separator 81 and conveyor 38. Thus, the position of the equalizing device 35 with reference to the belt conveyor 33 can be adjusted, preferably automatically, in response to deviation of one, two or more parameters from selected predetermined values.

The formation of the narrow shower 46 as the last stage of gathering the withdrawn fibers into the stream S1 renders it possible to admit into the duct 32 accurately metered quantities of fibers so that the stream S1 is substantially uniform even before it reaches the equalizing device 35. The combination of the shower forming means 31, 32, 34 with the equalizing device 35 ensures that the inlet of the conduit 71 receives identical quantities of fibers per unit of time.

The conveyor 76 delivers a continuous file of spaced-apart batches A1 to the lower reach of the conveyor 131 at the aforementioned transfer station 123 and is installed at one end of a stream forming zone Z2 whose other end is adjacent to the draping device U. The peripheral surface 75 of the conveyor 76 is formed with a series of equidistant elongated recesses or pockets 111 wherein the batches A1 are formed under the action of suction which is created by an air evacuating means in the form of a suction chamber 141 within the confines of the conveyor 76 (hereinafter called wheel). The bottom walls of the pockets 111 are formed with suction ports 139 (see particularly FIGS. **4*b* and 4*c*) which constitute a means for pneumatically drawing fibers into the respective pockets 111 during a certain stage of each revolution of the wheel 76. The suction generating device which draws air from the suction chamber 141 is not specifically shown in the drawing; if desired, the intake of the fan 83 in the cyclone separator 81 or the intake of the fan 51 of FIG. 2*a* can be connected to the outlet of the suction chamber 141**.

Figures 4, 4A:
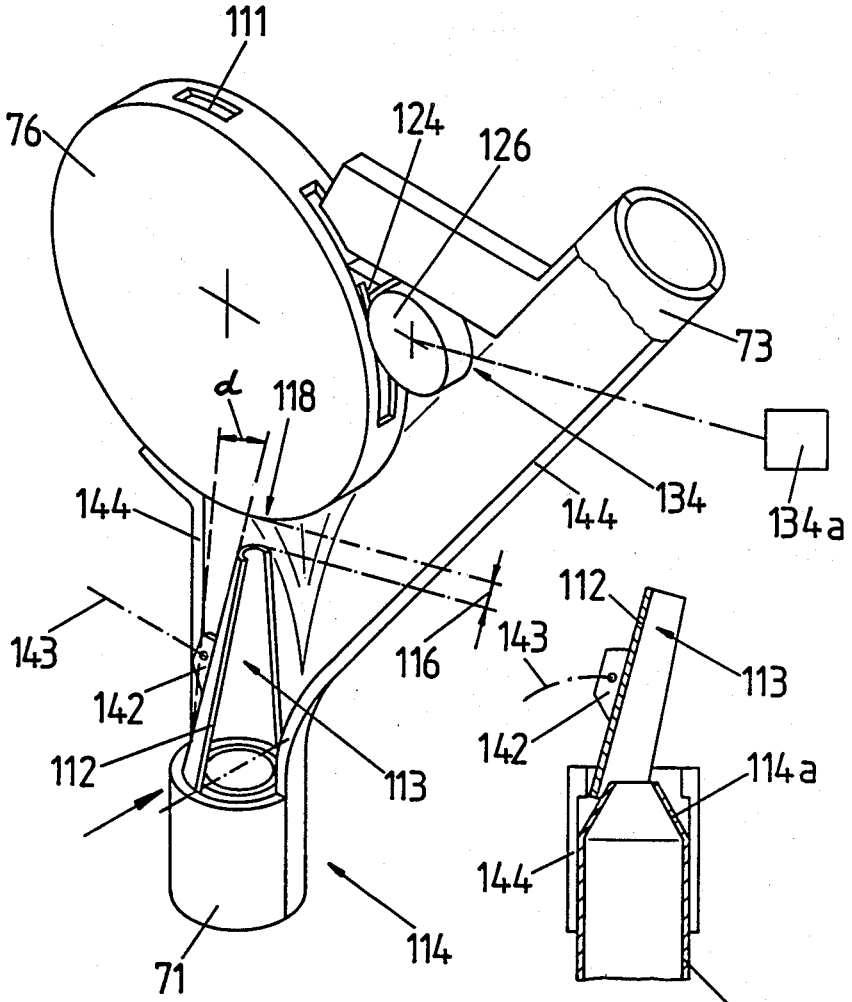
FIG. 4 is a perspective view of the rotary stream converting conveyor and of the adjacent components of means for moving the narrow stream toward as well as for transporting the remnant of such stream away from the batch forming station.
FIG. 4*a* is a sectional view of a detail in FIG. 4.
Figure 5:
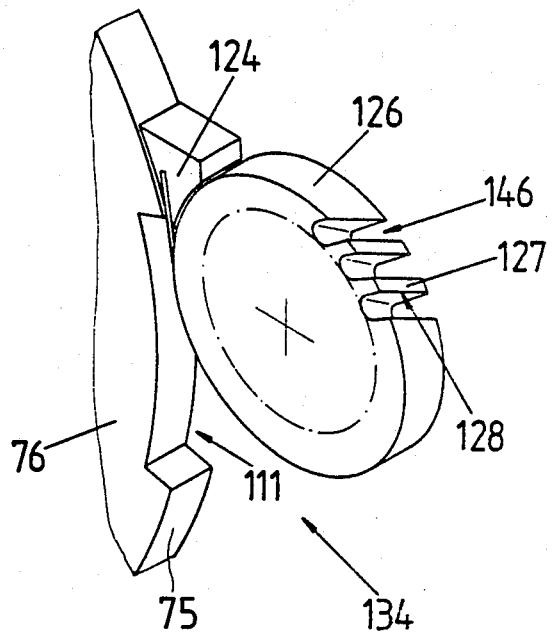
FIG. 5 is a perspective view of the device which trims the batches in the pockets of the stream converting conveyor.

The outlet 114 of the pneumatic conduit 71 is spaced apart from the peripheral surface 75 of the wheel 76 so as to provide room for an adjustable tobacco-guiding wall 112 whose end section 113 is adjacent to but still spaced apart from the peripheral surface 75 (see particularly FIG. 4). The inclination of the guide wall 112 is selected in such a way that successive increments of at least the major portion of the trimmed stream S1 which is caused to advance beyond the outlet 114 of the conduit 71 impinge upon the peripheral surface 75 at a predetermined angle so that the increments of the stream S1 have a component of movement in the direction (arrow B) of rotation of the wheel 76. The direction in which the stream S1 impinges upon the wheel 76 is neither radial nor tangential with reference to the peripheral surface 75. This can be readily seen in FIG. **3*b*. The width of the stream S1 (as considered in the axial direction of the wheel 76) equals or approximates the width of the pockets 111. In FIG. 4, the angle alpha denotes the inclination of the leader of the stream S1 (namely of that portion of the stream S1 which advances along the guide wall 112 and beyond its end section 113) with reference to a plane which extends radially of the wheel 76 and includes the axis of rotation of the wheel. The just discussed inclination of the leader of the stream S1 at the station 118 ensures that fibrous material which is not accepted by the pockets 111 of the wheel 76 do not pile up at the peripheral surface 75 and thus cannot interfere with the formation of batches A1 in successive pockets 111. Moreover, such inclination of the leader of the stream S1 has been found to guarantee the assembly of a long series of identical of practically identical batches A1 which contributes significantly to the quality of the composite stream S2 and of the filler which is obtained as a result of equalizing, homogenizing and draping of the stream S2. A particularly important parameter of the batches A1 is their density; therefore, the aforediscussed monitoring device 129 is adjacent to the transfer station 123 and its signals can influence the position of the trimming or equalizing device 35** for the stream S1 as well as one or more other adjusting means which influence elements that can affect the density of the batches A1.

The inclination of the guide wall 112 (i.e., the angle alpha) and hence the position of the end section 113 with reference to the peripheral surface 75 of the wheel 76) can be adjusted by the monitoring device 129 (through a control unit 132) by way of a motor 136 (e.g., an electromagnet) and an operative connection 143 which is indicated in FIG. **3*b* by a phantom line. The end section 113 of the guide wall 112 has an extension 142 (see FIGS. 4 and 4*a*) which is coupled to the adjusting means (motor 136) by the aforementioned connection 143. The motor 136 can pivot the guide wall 112 in the region of the nozzle-like part 114*a* of the outlet 114 of the conduit 71. The guide wall 112 is mounted between the nozzle-like part 114*a* and a stationary portion 144** of the housing of the apparatus.

The reference character 116 (FIG. 4) denotes the distance between the end section 113 of the pivotable guide wall 112 and the peripheral surface 75 of the wheel 76. As can be seen in FIG. **3*b*, the suction chamber 141 in the wheel 76 extends upstream (through an angle 117) beyond the station 118 (i.e., beyond the locus of impingement of the leader of the trimmed stream S1 against the peripheral surface 75, as considered counter to the direction (arrow B) of rotation of the wheel 76). This ensures that the leader of the stream S1 is flexed (as indicated at 119 in FIG. 3*b*) counter to the direction of rotation of the wheel 76 and into the front or foremost portion of the oncoming pocket 111 to thus ensure an even more reliable filling of the pocket with the fibrous material of the stream S1. Such flexing of the leader of the stream S1 at 119 has been found to contribute significantly to more satisfactory filling of the pockets 111** with fibers and to more satisfactory homogenizing of the developing batches A1.

The stationary portion 144 of the housing of the improved apparatus surrounds the entire batch forming station 118 and connects the outlet of the conduit 71 with the intake end of the conduit 72 so that the non-accepted fibers (i.e., the remainder or remnant S1R of the stream S1) find their way into the conduit 72 and are entrained into the casing of the cyclone separator 81.

Figure 4B:
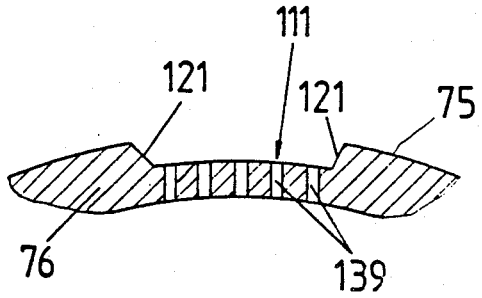
FIG. 4*b* is a fragmentary sectional view of one embodiment of a rotary stream converting conveyor which can be used in the machine of FIG. 1.

FIG. **4*b* shows a portion of the wheel 76 and one of the pockets 111 as well as the suction ports 139 which serve to pneumatically draw fibers into the pocket 111 while the latter travels past the suction chamber 141. The depth of the pocket 111 which is shown in FIG. 4*b* is constant and the mutual inclination of surfaces 121 at the front and rear ends of the pocket 111 (as considered in the direction of rotation of the wheel 76) is selected with a view to promote the penetration of fibers into the pocket while the latter approaches and travels past the batch forming station 118** of FIG. 3*b*. The inclination of each of the two surfaces 121 can be determined empirically to best suit the rated peripheral speed of the wheel 76, the rate of delivery of fibers via conduit 71, the selected inclination of the guide wall 112 relative to the peripheral surface 75 and/or certain other parameters which influence the homogeneousness of batches A1 in the pockets 111.

Figure 4C:
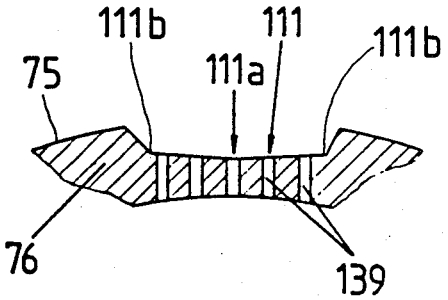
FIG. 4*c* is a similar fragmentary sectional view of a modified stream converting conveyor.

FIG. 4*c* shows a portion of a modified wheel 76 wherein the depth of the median portion 111*a* of the pocket 111 exceeds the depth of the end portions 111*b* of the pocket. Thus, the depth of each pocket 111 in the wheel 76 varies in the circumferential direction of the wheel. The advantages of batches A1 which are thicker in the middle and somewhat thinner at the ends (as seen in the direction of arrow D in FIG. 3*b*) will be pointed out with reference to FIGS. 6 and 7.

The wheel 76 cooperates with an adjustable trimming device 134 which influences a parameter of the batches A1 in successive pockets 111. The parameter is the mass of fibrous material per unit length of the batches. The device 134 is mounted in the housing of the apparatus upstream of the transfer station 123 and comprises a fixedly mounted knife 124 whose cutting edge is adjacent to the peripheral surface 75 of the wheel 76 and a rotary knife 126 having a set of cutters or teeth 127 with cutting edges 128 which are inclined with reference to the axis of the wheel 76 and to a line which is parallel to such axis and contacts the peripheral surface 75. The recesses or tooth spaces 146 between the cutters or teeth 127 of the rotary knife 126 are relatively deep to allow for penetration of separated fibers. The cutting edges 128 cooperate with the cutting edge of the knife 124 to perform a shearing action which ensures highly accurate equalization of the batches A1 ahead of the transfer station 123. The shearing action of the cutters 127 in cooperation with the fixedly mounted knife 124 ensures that the rotary knife 126 cannot pull fibers out of the pockets 111 which advance past the trimming device 134. The inclination of cutting edges 128 relative to the axis of the wheel 76 ensures that the separated or severed fibers automatically leave the adjacent tooth spaces 146 and enter the intake end of the conduit 72 to be advanced toward and into the casing of the cyclone separator 81.

The position of the trimming device 134 relative to the peripheral surface 75 of the wheel 76 can be altered in response to signals from the monitoring device 129 via control unit 132 and an adjusting element 134*a* (FIG. 3*b*), e.g., a reversible electric motor or the like. Signals from the monitoring device 129 cause the trimming device 134 to change the extent to which it influences a particular parameter (especially mass and/or density) of successive batches A1 before such batches reach the belt conveyor 131.

It has been shown that the aforediscussed inclination of the guide wall 112, namely so that the leader of the stream S1 does not travel radially and/or tangentially of the peripheral surface 75 of the wheel 76, contributes significantly to the formation of satisfactory batches A1 as well as to a reduction of the likelihood of clogging of the station 118 with fibrous material. Clogging of the station 118 not only affects the quality of the batches A1 but also necessitates prolonged stoppages of the apparatus with attendant huge losses in output. The placing of the end section 113 of the guide wall 112 at a predetermined distance (116) from the peripheral surface 75 of the wheel 76 is desirable and advantageous for the aforediscussed reasons, i.e., the leader of the stream S1 can be caused to flex (at 119) counter to the direction of rotation of the wheel 76 while it is being approached by an empty pocket 111 so that fibers which issue from the outlet 114 of the conduit 71 have a longer interval to properly fill the pockets. The selected inclination of the guide wall 112 influences the density of the batches A1, i.e., signals from the monitoring device 129 to the means (136, 143) for adjusting the inclination of the guide wall 112 can bring about an immediate change of the density of successive batches A1.

It is also within the purview of the invention to periodically pivot the guide wall 112 in synchronism with the speed of rotary movement of the wheel 76 so that the end section 113 of the guide wall 112 travels with that pocket 111 which is in the process of receiving successive increments of the stream S1. Such periodic pivoting of the guide wall 112 in and counter to the direction of rotation of the wheel 76 also contributes to more satisfactory filling of the pockets 111 by ensuring that each pocket can receive fibers for a longer interval of time.

The lower reach of the belt conveyor 131 is confined in a tobacco channel 150 which is open from below and which further receives an elongated suction chamber 148 adjacent to the upper side of the lower reach of the conveyor 131. The suction chamber 148 has a perforated bottom wall which extends from the transfer station 123 to the draping device U. The outlet 149 of the suction chamber 148 is connected with a suction generating device, not shown. The conveyor 131 is trained over a set of pulleys 151.

Some fibers are likely to descend from successive batches A1 at the transfer station 123 during transfer of such batches onto the lower reach of the conveyor 131. The thus separated fibers are collected in an upright duct 137 (FIG. 3*b*) which admits the separated fibers into a conduit 138 for delivery directly into the conduit 71 upstream of the batch forming station 118 or for delivery onto the conveyor 38 for transport into the lower portion 37 of the magazine 9.

The wheel 76 surrounds the aforementioned stationary suction chamber 141 as well as a stationary valving element 152 which extends along an arc W in the direction (arrow B) of rotation of the wheel 76 from the transfer station 123 to the batch forming station 118. The valving element 152 has one or more orifices 122 which admit blasts of compressed air into the adjacent pockets 111 while the pockets travel back toward the station 118. The purpose of such compressed air is to expel eventually adhering fibers from the pockets 111 before the pockets reach the leader of the stream S1 at the station 118. The blasts of compressed air are broken up into smaller jets during passage from the orifice or orifices 122 into the adjacent pockets 111 through the ports 139 in the bottom walls of such pockets. Fibers which are expelled from the pockets 111 travelling from the transfer station 123 toward the batch forming station 118 are propelled into the duct 137 and return into the conduit 71 via conduit 138.

The valving element 152 within the confines of the hollow wheel 76 is further provided with one or more additional orifices 153 which admit jets of compressed air into pockets 111 travelling past the transfer station 123. The jets which issue from the orifice or orifices 153 and entering the adjacent pockets 111 via corresponding ports 139 assist in the transfer of successive batches A1 from the wheel 76 onto the conveyor 131. The source or sources of compressed air for admission into the orifices 122 and 153 of the valving element 152 are not shown in the drawing. The batches A1 which reach the underside of the lower reach of the conveyor 131 are attracted to such lower reach by the pressure differential which is established by the suction chamber 148.

The valving element 152 ensures that each pocket 111 is empty not later than when it approaches the station 118. This guarantees that the ports 139 are not clogged with fibers and that the pressure (namely subatmospheric pressure) in each of the pockets 111 which are about to receive fibers matches a desired value as determined by the pressure in the suction chamber 141. Compressed air which issues from the orifice or orifices 122 of the valving element 152 further ensures the expulsion of impurities which could otherwise accumulate in the ports 139 and/or pockets 111.

The provision of means (137, 138) for returning into the conduit 71 those fibers which become separated from the batches A1 at or downstream of the transfer station 123 contributes to more economical operation of the apparatus.

The monitoring device 129 is a differential pressure detector with two sensors **129*a* extending into the suction chamber 148. As mentioned above, the device 129 monitors the density of successive batches A1 and transmits appropriate signals to one or more devices which are adjustable to influence such parameter of the batches A1 in a sense to maintain the parameter at a constant value. The control circuit 132 evaluates the signals from the monitoring device 129 and transmits appropriate signals to the adjusting means 89, 134*a*, 136 and/or to additional adjusting means. As mentioned above, the adjusting means 136 can select the angle (alpha) of inclination of the guide wall 112 relative to the peripheral surface 75 of the wheel 76, the adjusting means 134*a* can select the distance of the knives 124, 126 of the trimming device 134 from the peripheral surface 75, and the adjusting means 89 can select the distance of the trimming or equalizing device 35 from the lower reach of the belt conveyor 33. At the present time, the adjusting action of the adjusting means 89, 134*a* and 136 is preferably such that the density of successive batches A1 on the conveyor 131** will match or closely approximate an optimum value.

Signals from the control means 132 can also be utilized to operate an adjusting device 133 (denoted in FIG. **3*b* by phantom lines) which is used to regulate the pressure in the suction chamber 141 as a function of deviations of the density of batches A1 from an optimum value. Still further, signals which are generated by the monitoring device 129 can be used to influence a device (e.g., an adjustable gate or flow restrictor) which controls the rate of flow of fibers in the conduit 72 and/or the speed of the current of gaseous carrier medium and stream portion S1R in the conduit 72. Signals which are transmitted by the control unit 132 can further influence the speed of the conveyor 33 and/or 131, i.e., the speed of the stream S1 and/or S2. Still further, signals from the monitoring device 129 can be used to adjust the means for rotating and/or for otherwise moving elements of the withdrawing means and/or stream gathering means in the structure which is shown in FIGS. 2, 2*a* and 3*a***.

The aforedescribed monitoring device 129 in the form of a differential pressure detector can be replaced with other types of monitoring devices without departing from the spirit of the invention. For example, the monitoring device 129 can be replaced with a density measuring unit which operates with a source of corpuscular radiation. Details of the monitoring device 129 are described in the aforementioned commonly owned copending patent application Ser. No. 622,680 of Hartmann et al.

The duct 154 in the stream forming zone Z2 shown in FIG. **3*b* supplies a uniform shower of second fibrous material toward the path of movement of the single file of batches A1 at the underside of the lower reach of the conveyor 131. Fibrous material which is supplied by the duct 154 fills the gaps 147 between neighboring batches A1 of the file to form accumulations A2 which alternate with the batches A1 of the resulting composite stream S2. The (upper) discharge end of the duct 154 registers with the tobacco channel 150 for the lower reach of the conveyor 131**.

It is desirable and advantageous to ensure the establishment of smooth transitions between the longitudinal ends of the batches A1 and the adjacent ends of the accumulations A2. One mode of ensuring the establishment of such smooth transitions has been described with reference to FIG. **4*c*, i.e., by providing the wheel 76 with pockets 111 which are deeper in the middle (at 111*a*) than at the ends (111*b*). This enables a certain quantity of second fibers to overlie the thinner end portions of the neighboring batches A1 and to thus ensure a more satisfactory interlacing of first and second fibers in the aforementioned regions 227. Proper interlacing of first and second fibers in the regions 227 contributes to the stability of the composite stream S2 and hence to the stability of the filler which is obtained as a result of homogenizing and trimming of the stream S2 and to the stability of rod-shaped articles which are formed by the cutoff 54**.

The homogenizing device H of FIGS. **3*b* and 6 is located upstream of the equalizing device 211 and includes a rotary disc-shaped compacting or condensing cam 221 with four equidistant peripheral lobes 222 which shift portions of accumulations A2 in a direction toward the underside of the lower reach of the conveyor 131. The manner in which the lobes 222 shift the material of the accumulations A2 can be seen in FIG. 6 which shows that the lobes 222 leave depressions 223 in the regions 227 where the batches A1 abut the adjacent accumulations A2. This eliminates the likelihood of the presence of cavitities or unsatisfactorily densified portions in the stream which advances beyond the homogenizing device H and into the range of the rotary cutting or trimming disc or discs 231 of the equalizing device 211. The resulting filler is compacted and draped in the draping device U so that the web 216 and the filler together constitute a continuous cigarette rod which is subdivided by the cutoff 54 to yield plain cigarettes of desired length. The surplus (212 in FIG. 3*b*) which is removed by the equalizing device 211 is caused to descend along one side of a downwardly sloping baffle 212 and onto an endless belt conveyor 214 which returns the removed surplus to the magazine in the part VE2. The arrangement is preferably such that (contrary to the showing of FIG. 6) the trimming disc or discs 231 of the equalizing device 211 remove only fibrous material of the second type (accumulations A2) in order to ensure that the surplus 212** need not be classified according to fibers prior to returning it into the magazine of the part VE2 and/or into the magazine 9 of the part VE1.

The disc cam 221 of the homogenizing device H is driven by a variable-speed motor 225 (FIG. 3*b*) whose speed is synchronized with the speed of the motor (not shown) for the shaft of the wheel 76 so as to ensure that the rate of delivery of batches A1 onto the conveyor 131 is properly related to the frequency at which the lobes 222 of the disc cam 221 shift the adjacent fibers in a direction toward the conveyor 131 so as to form the aforementioned depressions 223 in the regions 227 where the end portions of the batches A1 abut the adjacent accumulations A2. Thus, the peripheral speed of the disc cam 221 (rotating in the direction of arrow 226) must be properly related to the speed of movement of the conveyor 131 in the direction of arrow D in order to ensure that the lobes 222 contact the stream S2 only in the aforediscussed regions 227.

It has been found that the lobes 222 reliably eliminate cavities in the regions 227 to thus ensure the formation of a highly satisfactory rod-like filler. The compacting or condensing and shifting action of the lobes 222 is preferably such that the density of the end portions of the accumulations A2 matches the density of the batches A1.

The pressure in the suction chambers 141 and 148 as well as the rate of delivery of fibers via duct 154 can be readily selected in such a way that the height of the accumulations A2 (as measured at right angles to the direction which is indicated by the arrow D) exceeds the height of the batches A1. This enables the operator to position the equalizing device 211 in such a way that its trimming disc or discs 231 remove only fibers of the second type with the aforediscussed advantages, namely the absence of any need for classification of the surplus 212 according to fibers prior to returning the surplus into the magazine of the part VE2 and/or VE1.

FIG. 7 shows a portion of a modified apparatus wherein the homogenizing device includes a trimming disc 231A and the draping unit U (not shown in FIG. 7). The cutting edge 235 at the periphery of the disc 231A has recesses or pockets 232 which provide the trimmed stream S2 with spaced-apart protuberances 233 in the regions 227, and such protuberances are shifted toward the axis of the filler during subsequent draping of the filler into a web 216 of cigarette paper or the like in the format of the draping device U. An advantage of the combined homogenizing and equalizing device of FIG. 7 is that the disc cam 221 or an analogous discree compacting of shifting means can be dispensed with because the shifting is effected by the draping device U which follows the disc 231A in the direction of arrow D.

The cutting edge 235 of the disc 231A can be provided with additional recesses or pockets 232 which provide the trimmed stream S2 with additional protuberances 234. Such protuberances disappear during draping in the device U and they provide the filler of the wrapped cigarette rod with uniformly spaced-apart dense portions which are needed for the making of dense-end cigarettes. The knife or knives of the cutoff 54 are then caused to cut across or adjacent to the densified portions (depressed protuberances 234) of the cigarette rod so that at least one end of each cigarette is denser than the intermediate portion of the cigarette.

The reference character 230 denotes a motor or other suitable adjusting means which can move the trimming disc 231 axially toward and away from the conveyor 131 in order to select the quantities of fibrous material which are removed by the cutting edge 235. The motor 230 can receive signals from the monitoring device 129 or from a device which monitors the density of the filler in the cigarette rod.

An important advantage of homogenization of the stream S2 in the regions 227 where the batches A1 abut the accumulations A2 is that the cavities (if any) in the regions 227 are eliminated by mere shifting of the material of the batches A1 and/or accumulations A2, i.e., without the need for admission of additional material for the express purpose of densifying the stream S2 at 227. All that is necessary is to shift some fibrous material (preferably the material of the accumulations A2), either prior to draping or in the course of the draping operation. The homogenizing action can be readily selected and/or adjusted in such a way that the density and/or other desirable parameters of the homogenized stream S2 in the regions 227 match the same parameters of the stream between the ends of the batches A1 and/or accumulations A2. As can be seen in FIGS. 6 and 7, the homogenizing action can precede or it can take place simultaneously with trimming of the stream S2.

The homogenizing device of FIG. 7 exhibits the additional advantage that one and the same trimming disc (231A) can be used to remove the surplus as well as to provide the trimmed stream S2 with additional protuberances 234 which enable the draping device U and the cutoff 54 to convert the web 216 and the stream S2 into cigarettes with dense ends.

Commonly owned U.S. Pat. No. 4,485,826 to Holznagel discloses an apparatus for making fillers wherein a rotary cam compresses spaced-apart portions of a tobacco stream. The purpose of such compacting action is to condense the stream in the regions where the filler of the cigarette rod is severed by the knife or knives of the cutoff.

The improved apparatus is relatively simple in spite of the fact that it is capable of forming and processing batches A1 with a heretofore unmatched degree of reliability. The drives for various moving parts can be identical with the drives of conventional machines (e.g., of the aforementioned PROTOS). The utilization of belt conveyors 33 and 131 which cooperate with suction chambers to attract the streams S1 and S2 also contributes to smooth and predictable operation of the apparatus for long intervals of time. Moreover, such mode of transporting the streams S1 and S1 ensures that the conduit 71 receives a continuous stream whose homogeneousness is highly satisfactory and leads to the formation of identical batches A1, and that the homogenizing device H or 231A+U receives a continuous composite stream which can be converted into a high-quality filler.

The aforediscussed means for recovering and returning non-accepted portions of the stream S1 and the fibers which descend into the duct 137 treat the fibers gently so that the dimensions and/or other desirable characteristics of the fibers are not affected during transport from the duct 137 into the conduit 71 and/or from the batch forming station 118 to the magazine 9.

The numerous possibilities of influencing the density of the batches A1 render it possible to maintain such density constant for any desired interval of time as well as to reestablish the desired density in practically immediate response to detection of unsatisfactory density at the station for the sensors 129*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming batches from fibers of the tobacco processing industry, particularly from particles of tobacco leaves, comprising the steps of establishing and maintaining a supply of fibers; withdrawing fibers from the supply; gathering the withdrawn fibers into a narrow filler stream including condensing the stream and moving the condensed filler stream longitudinally into, along and beyond a predetermined path wherein the filler stream is confined from all sides; and converting at least a portion of the filler stream which issues from said path into a series of substantially identical batches.

2. The method of claim 1, wherein said converting step includes admitting increments of the filler stream into successive pockets of a series of pockets on a driven conveyor.

3. The method of claim 1, wherein said gathering step includes converting the withdrawn fibers into a narrow shower wherein the fibers advance in a first direction and converting the shower into said filler stream wherein the fibers advance in a second direction which is inclined with reference to said first direction.

4. The method of claim 1, wherein said gathering step includes propelling the withdrawn fibers against one side of a driven belt conveyor.

5. The method of claim 4, further comprising the step of pneumatically holding the filler stream on the belt conveyor.

6. The method of claim 1, further comprising the step of equalizing the filler stream.

7. The method of claim 1, further comprising the step of regulating the quantity of fibers per unit length of the filler stream as a function of the selected quantity of fibers in the batches.

8. The method of claim 1, wherein said moving step comprises conveying the filler stream in a gaseous carrier medium and said converting step includes transforming a portion of the filler stream into batches, and further comprising the steps of segregating the remainder of the filler stream from the gaseous carrier medium and returning the segregated remainder of the filler stream to said supply.

9. The method of claim 8, wherein said segregating step includes admitting the remainder of the filler stream and the gaseous carrier medium into a cyclone separator.

10. The method of claim 1, further comprising the steps of advancing the batches in the form of a file with gaps between successive batches of the file, admitting second fibers into said gaps so as to form a composite stream consisting of said batches and accumulations of second fibers between the batches, equalizing the composite stream including removing second fibers, draping the equalized composite stream into a web of wrapping material to form a continuous rod, and subdividing the rod into rod-shaped articles of predetermined length.

11. The method of claim 10, wherein said batches are elongated and further comprising the step of homogenizing the composite stream in the regions of the ends of said batches.

12. The method of claim 11, wherein said homogenizing step includes shifting second fibers transversely of the composite stream.

13. The method of claim 12, wherein said advancing step includes transferring successive batches of said series onto one side of a belt conveyor and said shifting step includes moving portions of said accumulations toward the one side of the conveyor.

14. A method of making a rod which contains smokable material, particularly tobacco, comprising the steps of establishing and maintaining a supply of first fibers; withdrawing fibers from the supply; gathering the withdrawn fibers into a narrow filler stream including condensing the stream and moving the condensed filler stream longitudinally into, through and beyond an elongated conduit; converting at least a portion of the filler stream which issues from the conduit into a file of spaced-apart batches, including propelling successive increments of the filler stream into successive pockets of a series of pockets on a first conveyor moving in a predetermined direction in such a way that each of said increments has a component of movement in said direction on its way towards a pocket, and transferring the batches from the pockets onto a second conveyor wherein the batches form said file and the neighboring batches of the file define gaps; introducing second fibers into said gaps to thus form a composite stream wherein said batches alternate with accumulations of second fibers; and homogenizing the composite stream in the regions where said accumulations abut the neighboring batches.

15. The method of claim 14, wherein said introducing step includes showering second fibers into the gaps between the batches of said file.

16. The method of claim 14, wherein said homogenizing step includes shifting portions of said accumulations transversely of the composite stream toward the second conveyor.

17. The method of claim 14, further comprising the step of draping the composite stream into a web of wrapping material to form a continuous rod, and subdividing the rod into rod-shaped sections of predetermined length.

18. The method of claim 17, wherein said subdividing step includes cutting the rod across the batches.

19. The method of claim 17, wherein said subdividing step includes cutting the rod across the accumulations.

20. Apparatus for forming batches from fibers of the tobacco processing industry, particularly from particles of tobacco leaves, comprising a source of fibers; means for withdrawing fibers from said source; means for gathering the withdrawn fibers into a narrow filler stream including means for condensing the stream and for moving the condensed filler stream in a predetermined direction along a predetermined path, including a conduit which defines a predetermined portion of said path; and means for converting at least a portion of the filler stream into a series of substantially identical batches downstream of said conduit.

21. The apparatus of claim 20, wherein said converting means comprises a circulating conveyor.

22. The apparatus of claim 20, wherein said gathering means further comprises a belt conveyor defining a second portion of said path upstream of said predetermined portion.

23. The apparatus of claim 22, wherein said gathering means further comprises means for showering the withdrawn fibers onto said conveyor substantially transversely of said direction.

24. The apparatus of claim 22, wherein said conveyor is permeable to air and further comprising means for attracting the filler stream to said conveyor by suction.

25. The apparatus of claim 22, further comprising means for equalizing the filler stream on said conveyor.

26. The apparatus of claim 20, wherein said conduit is a pneumatic conveyor wherein the filler stream is conveyed in gaseous carrier medium.

27. The apparatus of claim 26, wherein said converting means is arranged to convert a portion of the filler stream and further comprising means for segregating the remainder of the filler stream from the gaseous carrier medium.

28. The apparatus of claim 27, wherein said segregating means comprises a cyclone separator.

29. The apparatus of claim 20, wherein said converting means comprises a circulating conveyor having a plurality of fiber-receiving pockets, said conduit being arranged to deliver at least the major part of the filler stream into the path of movement of said pockets with a component of movement in the direction of circulation of the circulating conveyor.

30. The apparatus of claim 20, further comprising means for advancing the batches from said converting means in the form of a file with gaps between successive batches of the file, and means for admitting second fibers into the gaps between the batches of the file so that the batches and the resulting accumulations of second fibers in said gaps form a composite stream consisting of alternating batches and accumulations.

31. The apparatus of claim 30, further comprising means for equalizing the composite stream.

32. The apparatus of claim 31, further comprising means for draping the equalized composite stream into a web of wrapping material.

33. The apparatus of claim 30, further comprising means for homogenizing the composite stream in the regions where the batches abut the accumulations of second fibers.

34. The apparatus of claim 33, wherein said homogenizing means comprises means for compressing the composite stream in said regions.

35. Apparatus for making a rod which contains a smokable material, particularly particles of tobacco leaves, comprising a source of first fibers; means for withdrawing fibers from said source; means for gathering the withdrawn fibers into a narrow filler stream including means for condensing the stream and for moving the condensed filler stream in a predetermined direction along a predetermined path, including a conduit defining a predetermined portion of said path and a belt conveyor defining a second portion of said path upstream of said predetermined portion; means for converting at least a portion of the filler stream into a series of batches downstream of said conduit, including a rotary conveyor having a peripheral surface with a succession of pockets for the fibers of said filler stream, said conduit having an outlet adjacent to said peripheral surface and arranged to direct at least the major part of the filler stream toward successive pockets with a component of movement in the direction of movement of said rotary conveyor; means for advancing the batches from said rotary conveyor in the form of a file with gaps between successive batches of the file, means for admitting second fibers into the gaps between the batches of the file so as to form a composite stream wherein batches of first fibers alternate with accumulations of second fibers; means for equalizing the composite stream; and means for draping the equalized composite stream into a web of wrapping material to form a continuous rod.

36. The apparatus of claim 35, further comprising means for homogenizing the composite stream in regions where the batches abut the adjacent accumulations of second fibers.

37. The apparatus of claim 35, further comprising means for subdividing the rod into rod-shaped articles of predetermined length.

38. The apparatus of claim 37, wherein said subdividing means comprises means for cutting the rod across the batches.

39. The apparatus of claim 37, wherein said subdividing means comprises means for cutting the rod across the accumulations.

40. A method of forming batches from fibers of the tobacco processing industry, particularly form particles of tobacco leaves, comprising the steps of establishing and maintaining a supply of fibers; withdrawing fibers from the supply; gathering the withdrawn fibers into a narrow stream and moving the stream longitudinally into, along and beyond a predetermined path wherein the stream is confined from all sides; equalizing the stream; and converting at least a portion of the stream which issues from said path into a series of substantially identical batches.

41. The method of claim 40, wherein said equalizing step includes uniformizing the height of the stream.

42. A method of forming batches from fibers of the tobacco processing industry, particularly from particles of tobacco leaves, comprising the steps of establishing and maintaining a supply of fibers; withdrawing fibers from the supply; gathering the withdrawn fibers into a narrow stream and moving the stream longitudinally into, along and beyond a predetermined path wherein the stream is confined from all sides; converting at least a portion of the stream which issues from said path into a series of substantially identical batches; and regulating the quantity of fibers per unit length of the stream as a function of the selected quantity of fibers in the batches.

43. Apparatus for forming batches from fibers of the tobacco processing industry, particularly from particles of tobacco leaves, comprising a source of fibers; means for withdrawing fibers from said source; means for gathering the withdrawn fibers into a narrow stream and for moving the stream in a predetermined direction along a predetermined path, including a conduit which defines a predetermined portion of said path and a belt conveyor defining a second portion of said path upstream of said predetermined portion; means for equalizing the stream on said conveyor; and means for converting at least a portion of the stream into a series of substantially identical batches downstream of said conduit.

44. The apparatus of claim 43, wherein said equalizing means comprises adjustable means for removing fibers from the stream.

45. The apparatus of claim 44, further comprising means for adjusting said removing means, including signal generating means for monitoring the quantity of fibers in the batches and means for changing the position of said removing means with reference to said conveyor in response to signals from said monitoring means.

46. Apparatus for forming batches from fibers of the tobacco processing industry, particularly from particles of tobacco leaves, comprising a source of fibers; means for withdrawing fibers from said source; means for gathering the withdrawn fibers into a narrow stream and for moving the stream in a predetermined direction along a predetermined path, including a conduit which defines a predetermined portion of said path; and means for converting at least a portion of the stream into a series of substantially identical batches downstream of said conduit, including a circulating conveyor having a plurality of fiber-receiving pockets, said conduit being arranged to deliver at least the major part of the stream into the path of movement of said pockets with a component of movement in the direction of circulation of the circulating conveyor.

47. The apparatus of claim 46, further comprising guide means for the fibers, said conduit having an outlet and said guide means being disposed between said outlet and the path of movement of said pockets.

48. The apparatus of claim 47, wherein said circulating conveyor comprises a rotary wheel having a peripheral surface, said pockets being provided in said peripheral surface and said guide means including a section arranged to guide the stream toward the path of movement of said pockets in a direction intermediate a radial and a tangential direction with reference to said peripheral surface.

49. The apparatus of claim 48, wherein said section is spaced apart from said peripheral surface and said converting means further comprises means for pneumatically drawing fibers into successive pockets ahead of said section, as considered in the direction of rotation of said wheel.

50. Apparatus for forming batches from fibers of the tobacco processing industry, particlularly from particles of tobacco leaves, comprising a source of fibers; means for withdrawing fibers from said source; means for gathering the withdrawn fibers into a narrow stream and for moving the stream in a predetermined direction along a predetermined path, including a conduit which defines a predetermined portion of said path; means for converting at least a portion of the stream into a series of substantially identical batches downstream of said conduit; means for advancing the batches from said converting means in the form of a file with gaps between successive batches of the file; means for admitting second fibers into the gaps between the batches of the file so that the batches and the resulting accumulations of second fibers in said gaps form a composite stream consisting of alternating batches and accumulations; and means for homogenizing the composite stream in the regions where the batches abut the accumulations of second fibers, said homogenizing means comprising means for compresssing the composite stream in said regions and said compressing means comprising a rotary cam having at least one lobe which engages said regions of the composite stream.

51. Apparatus for forming batches from fibers of the tobacco processing industry, particluarly from particles of tobacco leaves, comprising a source of fibers; means for withdrawing fibers from said source; means for gathering the withdrawn fibers into a narrow stream and for moving the stream in a predetermined direction along a predetermined path, including a conduit which defines a predetermined portion of said path; means for converting at least a portion of the stream into a series of substantially identical batches downstream of said conduit; means for advancing the batches form said converting means in the form of a file with gaps between successive batches of the file; means for admitting second fibers into the gaps between the batches of the file so that the batches and the resulting accumulations of second fibers in said gaps form a composite stream consisting of alternating batches and accumulations; and means for homogenizing the composite stream in the regions where the batches abut the accumulations fo second fibers, said homogenizing means comprising a trimming device arranged to remove fibers from the composite stream and to leave protuberances of second fibers in said regions, and means for draping the trimmed composite stream into a web of wrapping material so that the composite stream is converted into a rod-like filler.

* * * * *